US009405265B2

(12) United States Patent
Ju et al.

(10) Patent No.: US 9,405,265 B2
(45) Date of Patent: Aug. 2, 2016

(54) OPTION KIT ADAPTOR AND IMAGE FORMING APPARATUS EMPLOYING THE SAME

(71) Applicant: Samsung Electronics Co., Ltd., Suwon-si, Gyeonggi-do (KR)

(72) Inventors: Jeong-yong Ju, Suwon-si (KR); Young-hoon Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/474,577

(22) Filed: Sep. 2, 2014

(65) Prior Publication Data

US 2015/0293491 A1 Oct. 15, 2015

(30) Foreign Application Priority Data

Apr. 9, 2014 (KR) ..... 10-2014-0042537

(51) Int. Cl.
*G03G 21/16* (2006.01)
*G03G 15/00* (2006.01)

(52) U.S. Cl.
CPC ..... *G03G 21/1619* (2013.01); *G03G 21/1652* (2013.01); *G03G 15/5087* (2013.01); *G03G 15/80* (2013.01); *G03G 2215/00126* (2013.01)

(58) Field of Classification Search
CPC ..... H05K 7/1424; G03G 15/80; G03G 21/16; G03G 2221/16; G03G 2221/1647; G03G 21/1619; G03G 21/1652; G03G 15/5087; G03G 2215/00126
USPC ..... 399/90, 107, 110; 361/679.32
See application file for complete search history.

(56) References Cited

U.S. PATENT DOCUMENTS

| | | | | |
|---|---|---|---|---|
| 4,730,947 | A | 3/1988 | Ikeda et al. | |
| 4,908,637 | A * | 3/1990 | Chung et al. | 347/138 |
| 5,481,656 | A | 1/1996 | Wakabayashi et al. | |
| 5,825,401 | A * | 10/1998 | Wadley et al. | 347/247 |
| 6,282,099 | B1 * | 8/2001 | Wilson et al. | 361/753 |
| 6,412,749 | B1 * | 7/2002 | Supinski et al. | 248/674 |
| 2002/0176108 | A1 | 11/2002 | Jeon | |
| 2004/0094623 | A1 * | 5/2004 | Abundis et al. | 235/441 |
| 2013/0120928 | A1 * | 5/2013 | Peng et al. | 361/679.43 |
| 2015/0009617 | A1 * | 1/2015 | Yin et al. | 361/679.32 |
| 2015/0098194 | A1 * | 4/2015 | Hou et al. | 361/737 |

FOREIGN PATENT DOCUMENTS

| | | | | |
|---|---|---|---|---|
| CN | WO2013/163811 A1 * | 11/2013 | | H04M 1/02 |
| EP | 0 055 346 | 7/1982 | | |
| GB | 2 327 540 | 1/1999 | | |
| JP | 04-212877 * | 8/1992 | | B41J 29/00 |

OTHER PUBLICATIONS

Partial European Search Report issued Sep. 10, 2015 in corresponding European Application No. 15153362.7.

* cited by examiner

*Primary Examiner* — Sophia S Chen
(74) *Attorney, Agent, or Firm* — Staas & Halsey LLP

(57) ABSTRACT

An image forming apparatus including a printing unit for printing images on a recording medium and an option kit adaptor are provided. The image forming apparatus includes an installation member having an accommodation space, and an adaptor, on which two or more option kits are loaded, that is detachably attached to the accommodation space of the installation member.

12 Claims, 7 Drawing Sheets

OPTION KIT ADAPTOR AND IMAGE FORMING APPARATUS EMPLOYING THE SAME

CROSS-REFERENCE TO RELATED APPLICATIONS

This application is related to, and claims the priority benefit of, Korean Patent Application No. 10-2014-0042537, filed on Apr. 9, 2014, in the Korean Intellectual Property Office, the disclosures of which are incorporated herein in their entirety by reference.

BACKGROUND

1. Field

One or more embodiments relate to an option kit adaptor, on which option kits providing an image forming apparatus with additional functions are installed, and an image forming apparatus adopting the option kit adaptor.

2. Description of the Related Art

Additional functions of an image forming apparatus may be realized by installing an option kit on the image forming apparatus, for example, a printer, a copy machine, etc. For example, a fax kit may be installed on a main body of the image forming apparatus to perform a facsimile function.

To perform an additional operation as above, a user may disassemble a main body of an image forming apparatus partially, and may directly install a mechanical structure for installing an option kit on the image forming apparatus and an electrical connecting structure for electrically connecting the option kit to a main controller in the main body of the image forming apparatus. However, the user may break the internal structures of the image forming apparatus or may install the mechanical and electrical connecting structures in a wrong location, and thus, the image forming apparatus may be damaged.

An installation member, including a mechanical structure for installing an option kit on a main body of an image forming apparatus and an electrical connecting structure for electrically connecting the option kit to a main controller of the image forming apparatus, may be provided in advance. The user may install the option kit on the installation member to perform additional functions. However, a plurality of installation members may be necessary to realize a plurality of additional functions. That is, since option kits for realizing the additional functions may have different types of mechanical structures and electrical connecting structures, a plurality of installation members of various types may have to be provided in the image forming apparatus. Therefore, a structure of the main body of the image forming apparatus becomes complicated and a size of the image forming apparatus may be increased. The user may have to find an appropriate installation member for an option kit of a particular kind to install the option kit in the image forming apparatus.

SUMMARY

One or more embodiments of an exemplary embodiment include an option kit adaptor on which two or more option kits may be installed.

One or more embodiments of an exemplary embodiment include an image forming apparatus having a simple installation structure to install two or more option kits.

One or more embodiments of an exemplary embodiment include an image forming apparatus of a small size in which two or more option kits are installed.

Additional aspects will be set forth in part in the description which follows and, in part, will be apparent from the description, or may be learned by practice of the presented embodiments.

According to one or more embodiments, an image forming apparatus includes a printing unit to print images on a recording medium, an installation member having an accommodation space, and an adaptor, on which two or more option kits are loaded, detachably attached to the accommodation space of the installation member.

The image forming apparatus may include a main control unit to control operations of the image forming apparatus, and an option interface unit to connect the two or more option kits to the main control unit when the adaptor is installed in the installation member.

The option interface unit may include two or more connecting portions that are respectively connected to the two or more option kits.

The adaptor may include a guide rail, and the installation member may include a guide unit to support the guide rail so as to guide the adaptor to the accommodation space.

The image forming apparatus may include a housing having an installation hole, wherein a cover that is removable is disposed on the installation hole. The adaptor may include a fixing bracket that blocks the installation hole. The fixing bracket may include a connecting hole to connect the two or more option kits to the outside.

The fixing bracket may include a fixing hole to fix the adaptor.

The two or more option kits may include at least two of a fax card, a wireless fidelity (Wi-Fi) card, and a network card.

According to one or more embodiments, an option kit adaptor that may be detachably attached to an image forming apparatus through an installation hole formed in the image forming apparatus, the option kit adaptor includes a first member; a second member forming a first accommodation space, in which a first option kit is installed, with the first member, and a third member forming a second accommodation space, in which a second option kit is installed, with the first member.

The option kit adaptor may include a fixing bracket to block the installation hole.

The fixing bracket may include fixing holes to fix the option kit adaptor to the image forming apparatus.

The option kit adaptor may include a ground bracket to ground the first option kit and the second option kit.

The option kit adaptor may include a guide rail that is guided by a guide unit of an installation member in the image forming apparatus.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
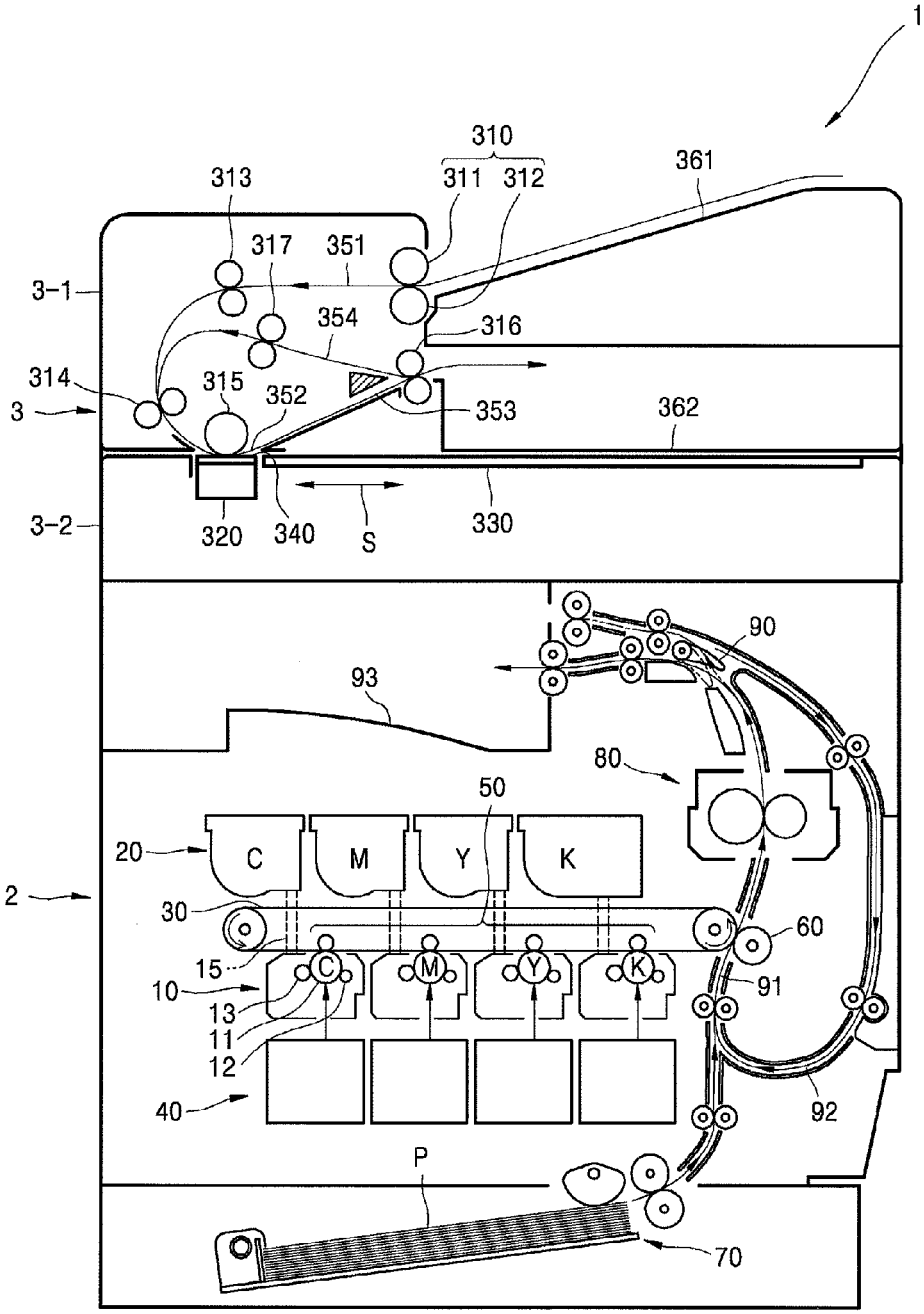
FIG. 1 is a schematic diagram of an image forming apparatus according to an embodiment.

Reference will now be made in detail to embodiments, examples of which are illustrated in the accompanying drawings, wherein like reference numerals refer to like elements throughout. In this regard, the embodiments may have different forms and should not be construed as being limited to the descriptions set forth herein. Accordingly, the embodiments are described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, embodiments will be described with reference to accompanying drawings.

FIG. 1 is a schematic diagram of an image forming apparatus 1 according to an embodiment. Referring to FIG. 1, the image forming apparatus 1 includes a printing unit 2. The printing unit 2 may print images on a recording medium P in various printing methods, for example, an inkjet method, a thermal transfer method, an electrophotographic method, etc. The printing unit 2 according to an embodiment prints color images by using the electrophotographic method.

The printing unit 2 includes a plurality of developing units 10 and a plurality of developing agent receiving units 20 in which a developing agent may be accommodated. The plurality of developing units 10 and the plurality of developing agent receiving units 20 may be connected to each other respectively through a plurality of developing agent supplying paths 15. The developing agents accommodated in the plurality of developing agent receiving units 20 may be respectively supplied to the plurality of developing units 10 via the plurality of developing agent supplying paths 15. The plurality of developing agent receiving units 20 and the plurality of developing units 10 may be independently replaced.

To perform a full-color printing operation, the plurality of developing units 10 may include developing units 10C, 10M, 10Y, and 10K to respectively develop cyan (C), magenta (M), yellow (Y), and black (K) colors. The plurality of developing agent receiving units 20 may include developing agent receiving units 20C, 20M, 20Y, and 20K respectively including C, M, Y, and K developing agents that are to be supplied respectively to the plurality of developing units 10C, 10M, 10Y, and 10K. However, one or more embodiments are not limited thereto, and more developing agent receiving units 20 and developing units 10 to receive and develop other developing agents of various colors such as light magenta and white may be provided. The image forming apparatus including the plurality of developing units 100, 10M, 10Y, and 10K and the plurality of developing agent receiving members 20C, 20M, 20Y, and 20K are described. Unless otherwise specified, references with Y, M, C, and K refer to elements for developing Y, M, C, and K developing agents, respectively.

Each of the developing units 10 includes a photosensitive body 11. The photosensitive body 11 according to an embodiment may have a cylindrical shape, on which a photosensitive layer is formed, however, one or more embodiments are not limited thereto. A charging roller 12 charges the photosensitive body 11 to have a uniform surface potential. A charging brush, a corona charger, and the like may be used instead of the charging roller 12. A developing roller 13 supplies a developing agent in the developing unit 10 to the photosensitive body 11.

Although not illustrated in FIG. 1, the developing unit 10 may include a charging roller cleaner to remove impurities such as the developing agent or dust attached to the charging roller 12, a cleaning member to remove the developing agent remaining on a surface of the photosensitive body 11 after an intermediate transfer process that will be described later, and a regulating member to regulate the amount of the developing agent supplied to a developing region where the photosensitive body 11 and the developing roller 13 face each other.

When a dual-component development method is used, a magnetic carrier may be accommodated in the developing unit 10, and the developing roller 13 is separated tens to hundreds of μm from the photosensitive body 11. Although not illustrated in FIG. 1, the developing roller 13 may be a magnetic roller, or may include a developing sleeve and a magnetic roller disposed in the developing sleeve. The developing agent supplied from one of the developing agent receiving units 20 to the developing unit 10 is attached to a surface of the magnetic carrier. The magnetic carrier may be carried to the developing region where the photosensitive body 11 and the developing roller 13 face each other while being attached to the surface of the developing roller 13. Only the developing agent may be supplied to the photosensitive body 11 by a developing bias applied between the developing roller 13 and the photosensitive body 11 so as to develop an electrostatic latent image formed on the surface of the photosensitive body 11 into a visible image. If a mono-component development method that does not include a carrier is used, the developing roller 13 may rotate in contact with the photosensitive body 11 or may rotate while being separate by tens to hundreds of μm from the photosensitive body 11.

When the dual-component development method is used, the developing unit 10 may include an agitating/conveying member that mixes and agitates the developing agent supplied from the developing agent receiving unit 20 with the carrier in the developing unit 10 to supply the mixture to the developing roller 13. When the mono-component development method is used, the developing unit 10 may include a conveying member that agitates the developing agent introduced from the developing agent receiving unit 20 and conveys the developing agent to the developing roller 13.

The developing method of the image forming apparatus according to an embodiment is described above, however, one or more embodiments are not limited thereto, and the developing method may be variously modified.

A light scanning unit 40 irradiates light that may be modulated in correspondence with image information to the photosensitive body 11 to form an electrostatic latent image on the photosensitive body 11, and examples of the light scanning unit 40 may include a laser scanning unit (LSU) using a laser diode as a light source or a light scanning unit using a light-emitting diode (LED) as a light source.

The images formed on the photosensitive bodies 11 of the plurality of developing units 10C, 10M, 10Y, and 10K may be temporarily transferred on an intermediate transfer belt 30. A plurality of intermediate transfer rollers 50 are disposed to face the photosensitive bodies 11 of the plurality of developing units 10C, 10M, 10Y, and 10K with the intermediate transfer belt 30 interposed therebetween. An intermediate transfer bias may be applied to the plurality of intermediate transfer rollers 50 to transfer the images formed on the photosensitive bodies 11 to the intermediate transfer belt 30. A corona transfer unit or a transfer unit of a pin scorotron may be used instead of the intermediate transfer roller 50.

A transfer roller 60 may be located facing the intermediate transfer belt 30. A transfer bias may be applied to the transfer roller 60 to transfer the image transferred on the intermediate transfer belt 30 to a recording medium P.

According to an embodiment, the image formed on the photosensitive body 11 is intermediately transferred to the intermediate transfer belt 30, and then, is transferred to the recording medium P that passes between the intermediate transfer belt 30 and the transfer roller 60. However, embodiments are not limited thereto. That is, the recording medium P passes between the intermediate transfer belt 30 and the photosensitive body 11 so that the image is directly transferred to the recording medium P. According to an embodiment, the transfer roller 60 is not provided.

A fusing device 80 applies heat and/or pressure to the image transferred onto the recording medium P to fuse the image in the recording medium P. The fusing device 80 is not limited to the example illustrated in FIG. 1.

According to an embodiment, the light scanning unit 40 irradiates a plurality of light rays that are modulated according to image information of each color to the photosensitive bodies 11 of the plurality of developing units 10C, 10M, 10Y, and 10K to form electrostatic latent images on the photosensitive bodies 11. The electrostatic latent images on the photosensitive bodies 11 of the plurality of developing units 10C, 10M, 10Y, and 10K are developed into visible images by the C, M, Y, and K developing agents supplied from the plurality of developing agent receiving units 20C, 20M, 20Y, and 20K to the plurality of developing units 100, 10M, 10Y, and 10K. The visible images may be intermediately transferred to the intermediate transfer belt 30, for example, sequentially. The recording medium P loaded in a paper feed unit 70 may be conveyed along a paper feeding path 91 to a region where the transfer roller 60 and the intermediate transfer belt 30 face each other. The image formed on the intermediate transfer belt 30 may be transferred to the recording medium P by the transfer bias applied to the transfer roller 60. When the recording medium P passes through the fusing device 80, the image is fixed on the recording medium P due to the heat and pressure. The recording medium P, on which the fusing of the image has finished, is discharged to a discharge unit 93. If a duplex printing is performed, a selection device 90 guides the recording medium P that has passed through the fusing device 80 so that the image may be printed on a surface thereof to a duplex printing path 92. Accordingly, the recording medium P may be supplied between the intermediate transfer belt 30 and the transfer roller 60 again, and another image is transferred to a rear surface of the recording medium P. The recording medium P passes through the fusing device 80 again, and, may be discharged to the discharge unit 93 by the selection device 90.

The image forming apparatus 1 may include a scanner unit 3. The scanner unit 3 may include a document feeding unit 3-1 and a scanning unit 3-2.

The scanning unit 3-2 includes a scanning member 320 to read images from a document. The scanning member 320 irradiates light to the document and receives light reflected by the document to read the images on the document. The scanning member 320 may be a contact-type image sensor (CIS) or a charge-coupled device (CCD).

The scanner unit 3 according to an embodiment is a combined-type scanner device, in which both a flatbed type scanning operation and a document feed type scanning operation are possible. The scanning unit 3-2 includes a platen glass 330, on which a document may be placed in order to read images from the document in the flatbed type scanning operation. The scanning unit 3-2 may include a scanning window 340 in order to read images from the document in the document feed type scanning operation. The scanning window 340 may be, for example, a transparent member.

In a document feed type scanning operation, the scanning member 320 may be disposed under the scanning window 340. In a case of a flatbed type scanning operation, the scanning member 320 may be transferred in a sub-scanning direction S, that is, a lengthwise direction of the document, by a transfer unit (not illustrated) under the platen glass 330. When the flatbed type scanning operation is applied, the platen glass 330 may need to be exposed to the outside in order to place the document on the platen glass 330. To do this, the document feeding unit 3-1 may be rotated with respect to the scanning unit 3-2.

The document feeding unit 3-1 moves the document so that the scanning member 320 may read an image recorded on the document and discharges the document that has been read. To do this, the document feeding unit 3-1 includes a document feeding path, and the scanning member 320 reads the image from the document that is fed through the document feeding path. The document feeding path may include a supply path 351, a scanning path 352, and a discharge path 353. The scanning member 320 may be disposed on the scanning path 352, and the image recorded on the document is read by the scanning member 320 while the document passes through the scanning path 352. The supply path 351 is a path to supply the document to the scanning path 352, and the document loaded in a supply tray 361 is supplied to the scanning path 352 via the supply path 351. The discharge path 353 is a path to discharge the document that has passed through the scanning path 352. Therefore, the document loaded in the supply tray 361 is transferred along the supply path 351, the scanning path 352, and the discharge path 353, and then, is discharged to a discharge tray 362.

An automatic document feed (ADF) unit 310 separates documents loaded in the supply tray 361 one-by-one and supplies the document to the supply path 351. The ADF unit 310 may include a first ADF roller 311 and a second ADF roller 312 that are engaged with each other to rotate in opposite directions to each other. The first ADF roller 311 rotates in a direction in which the document is transferred to the supply path 351, and the second ADF roller 312 rotates in an opposite direction thereto. If two or more documents are supplied between the first and second ADF rollers 312 and 312, the first and second ADF rollers 311 and 312 may separate only one document by using a difference between frictional forces and supply the document to the supply path 351. Supply rollers 313 and 314 to transfer the document may be disposed on the supply path 351. A feeding roller 315 to transfer the document may be disposed on the scanning path 352 to face the scanning member 320. A discharge roller 316 to discharge the document, on which the reading operation is finished, may be disposed on the discharge path 353. For duplex scanning, the document, a surface of which has been read, may be supplied to the scanning path 352 again via a re-supply path 354. A re-supply roller 317 may be disposed on the re-supply path 354. Each of the supply rollers 313 and 314, the discharge roller 316, and the re-supply roller 317 may include a pair of rollers that are rotated while engaged with each other to transfer the document. One roller of the pair of rollers may be a driving roller and the other may be a driven roller that may be rotated by being compressed by the driving roller. Although not illustrated in FIG. 1, one or more sensors to sense the document may be disposed on the document feeding path.

Figure 2:
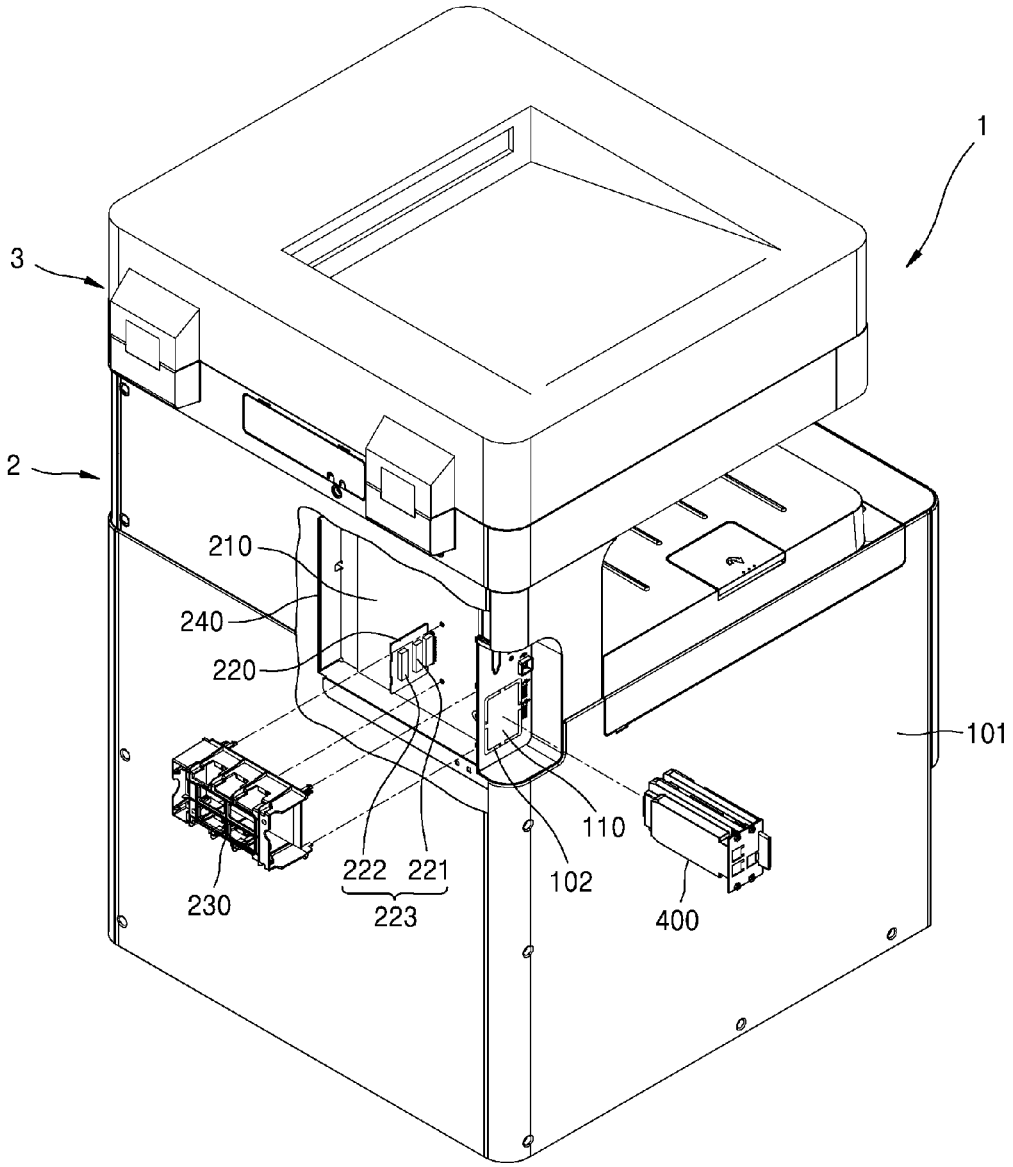
FIG. 2 is a partially exploded perspective view of an exemplary image forming apparatus.

FIG. 2 is a partially exploded perspective view of the image forming apparatus 1 illustrated from a rear of the image forming apparatus 1. Referring to FIG. 2, the image forming apparatus 1 includes a main control unit 210. The main control unit 210 controls operations of the image forming apparatus 1, which include printing processes and image reading processes. The main control unit 210 may be electrically connected to the components of the image forming apparatus 1 to transmit/receive control signals to control operations of the components to/from the components. According to an embodiment, the main control unit 210 may be configured as a central processing unit (CPU) or a circuit board including the CPU. Each of elements included in the main control unit 210 may be realized by software stored in a memory of the main control unit 210, or electrical circuits.

The image forming apparatus 1 according to an embodiment has a printing function, and a scanning function. Functions of the image forming apparatus 1 may be expanded when an option kit is installed on the image forming apparatus 1. For example, functions such as a facsimile function using one or more telephone wires, a Wi-Fi communication function to connect to an external device or an external host via wireless communication, or a network communication function to connect to an external device or an external host via wired communication may be added as a function of the image forming apparatus 1. To do this, one or more option kits may be installed to the image forming apparatus 1. The user may expand the functions of the image forming apparatus 1, for example, by buying and installing an option kit on the image forming apparatus 1.

According to an embodiment of the image forming apparatus 1, two or more option kits, namely, first and second option kits 510 and 520, (see, for example, FIG. 5) may be installed by using one installation structure. To do this, as illustrated in FIG. 2, the image forming apparatus 1 may include an adaptor 400 on which two or more option kits, namely, first and second option kits 510 and 520, (see, for example, FIG. 5) may be installed, an installation member 230 on which the adaptor 400 may be installed, and an option interface unit 220 to form an electric interface between the first and second option kits 510 and 520 (see, for example, FIG. 5) and the main control unit 210.

Figure 3:
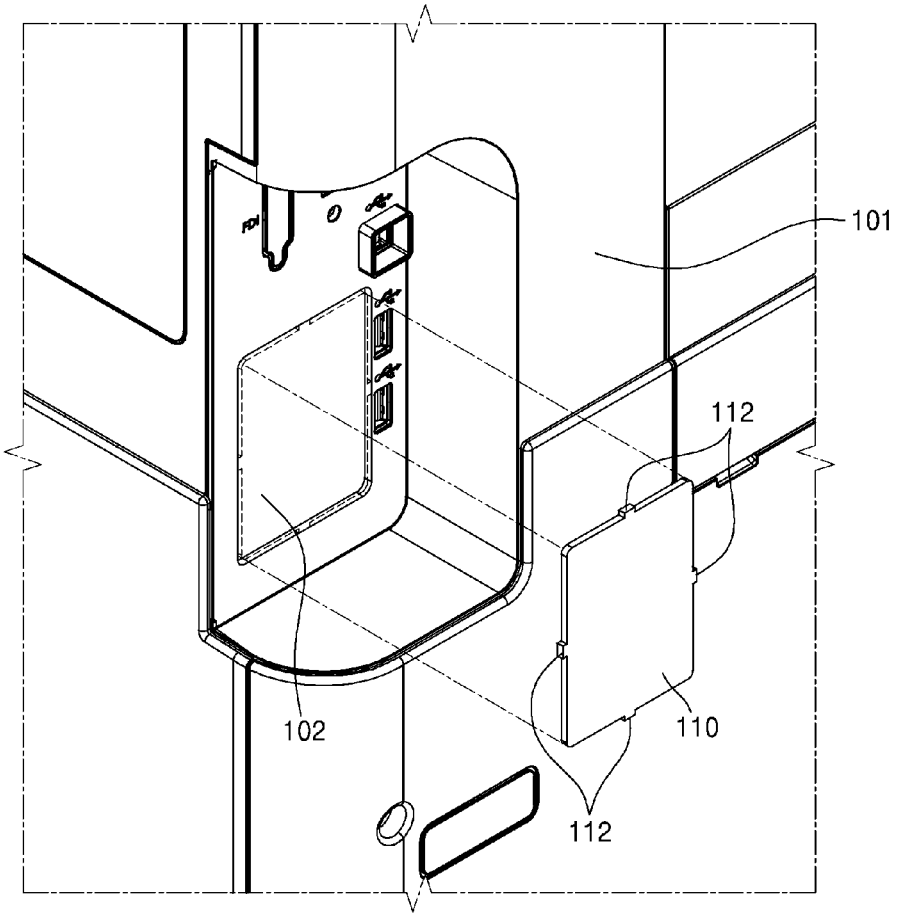
FIG. 3 is a perspective view of an exemplary mounting hole and a cover.
Figure 4:
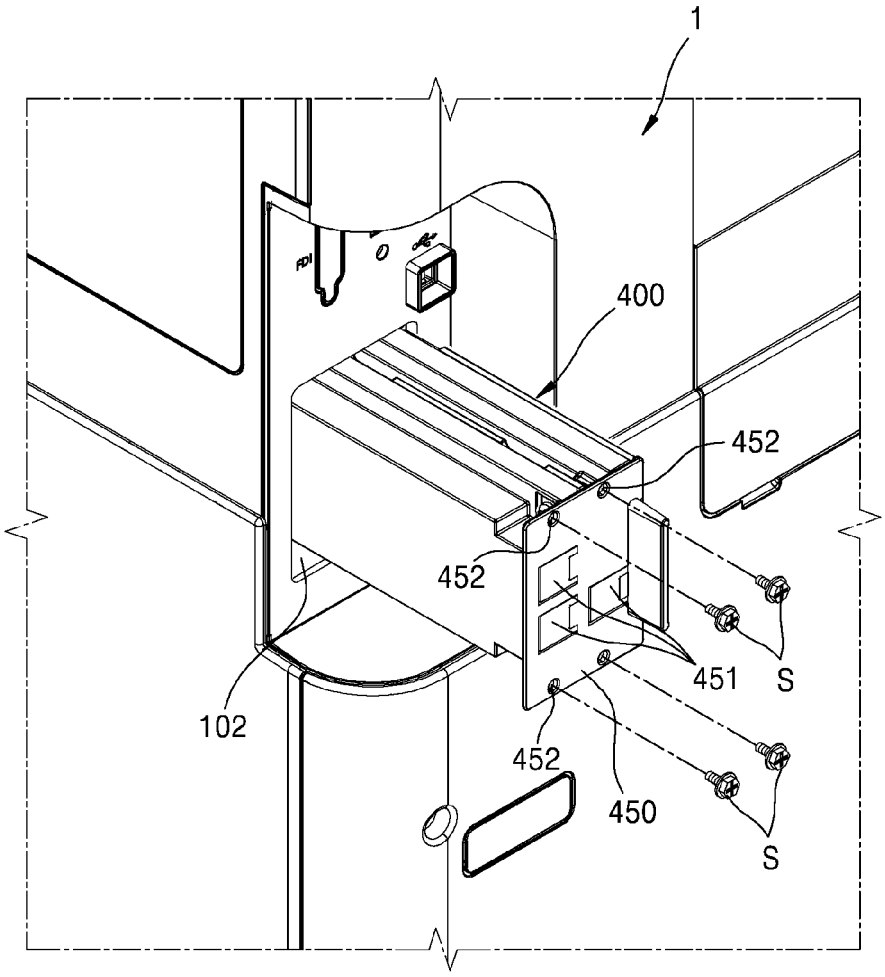
FIG. 4 is a perspective view illustrating an exemplary state in which an adaptor is mounted on an image forming apparatus via the mounting hole.

An installation hole 102 to install the adaptor 400 may be formed in a housing 101 that forms an outer appearance of the image forming apparatus 1. A cover 110 covers the installation hole 102. The cover 110 may be removed in order to install the adaptor 400. FIG. 3 is a perspective view of the installation hole 102 and the cover 110, and FIG. 4 is a perspective view illustrating the adaptor 400 that may be installed on the image forming apparatus 1 via the installation hole 102.

Referring to FIG. 3, as illustrated by a dotted line, the cover 110 may be connected to an edge of the installation hole 102 by a plurality of connecting protrusions 112 to block the installation hole 102. The cover 110 may be integrally formed with the housing 101. Before installing the adaptor 400, the cover 110 may be removed to open the installation hole 102 by cutting the plurality of connecting protrusions 112. Since the housing 101 may be manufactured by, for example, a plastic molding process, the cover 110 may be easily removed by using a tool or applying a force to the cover 110. The cover 110 that is removable in FIG. 3 is an example, and embodiments are not limited thereto. For example, although not illustrated in the drawings, the cover 110 may be detachably coupled to the housing 101 in a screw coupling method or a snap fit coupling method.

When the cover 110 is removed, the installation hole 102 may be opened as illustrated in FIG. 3. In addition, as illustrated in FIG. 4, the adaptor 400 may be pushed into the image forming apparatus 1 via the installation hole 102 so that the adaptor 400 may be installed in the image forming apparatus 1. The adaptor 400 may be fixed in the image forming apparatus 1 by using coupling members, for example, screws S, through fixing holes 452 in a fixing bracket 450.

Figure 5:
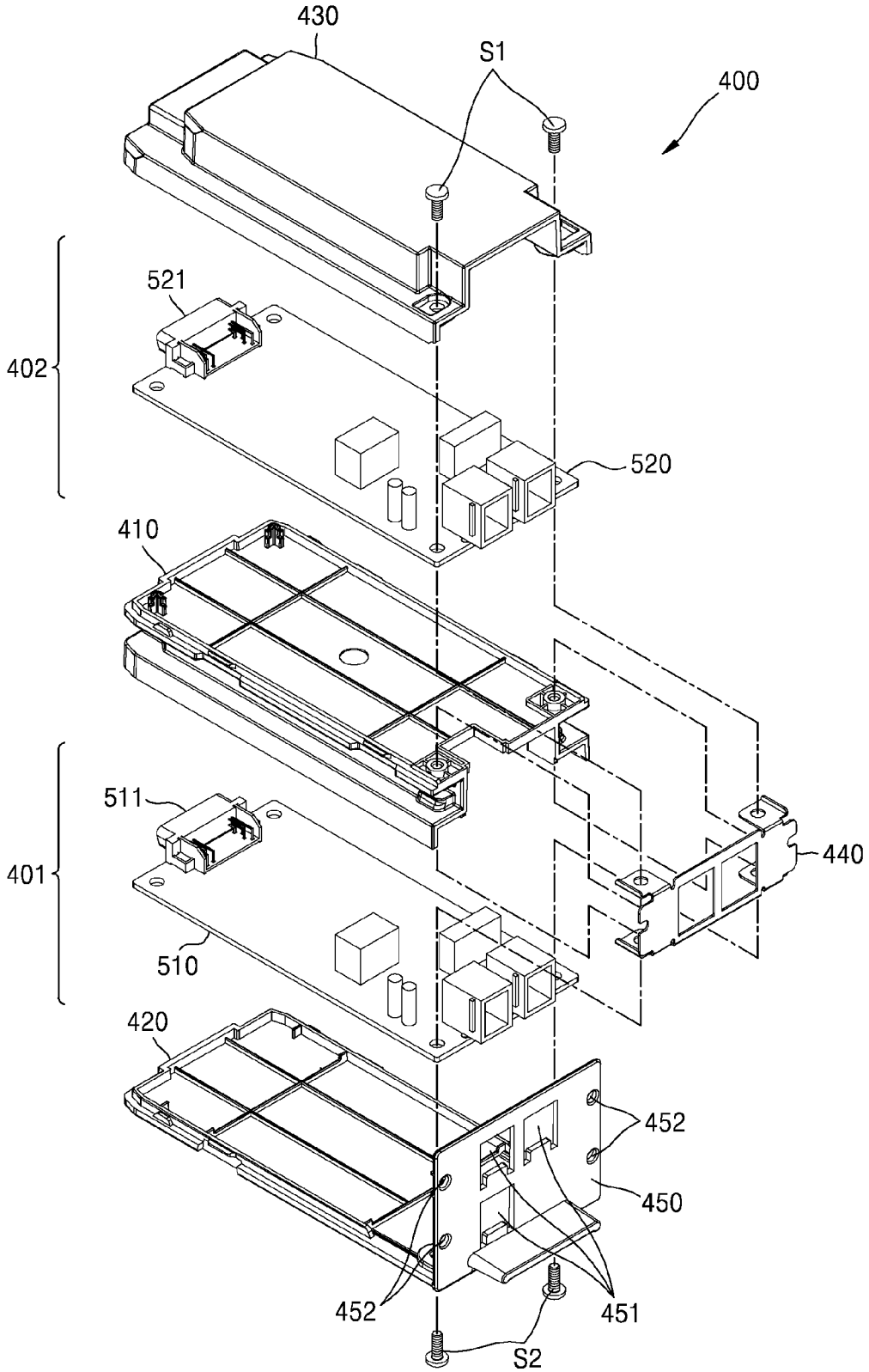
FIG. 5 is an exploded perspective view of an adaptor according to an embodiment.

FIG. 5 is an exploded perspective view of the adaptor 400. Referring to FIG. 5, two option kits, namely, the first and second option kits 510 and 520, may be installed on the adaptor 400. The adaptor 400 includes a first member 410 and a second member 420 located at a side of the first member 410 (for example, a lower portion of the first member 410 in FIG. 5) to form a first accommodation space 401, in which the first option kit 510 is accommodated, with the first member 410. The adaptor 400 may include a third member 430 located at the other side of the first member 410 (for example, an upper portion of the first member 410 in FIG. 5) to form a second accommodation space 402, in which the second option kit 520 is accommodated, with the first member 410.

The adaptor 400 may include a ground bracket 440 to ground the first and second option kits 510 and 520. The adaptor 400 may include the fixing bracket 450 to block the installation hole 102, when the adaptor 400 is installed in the image forming apparatus 1. The fixing bracket 450 may be integrally formed with, for example, the second member 420, and may be coupled to the second member 420. The fixing bracket 450 may include a connecting hole 451 to connect the first and second option kits 510 and 520 to the outside (for example, a telephone line or a network communication line).

The first option kit 510 may be disposed between the first and second members 410 and 420 and the second option kit 520 may be disposed between the first and third members 410 and 430. The ground bracket 440 may be disposed to contact ground portions of circuit patterns in the first and second option kits 510 and 520. As illustrated in FIG. 5, a screw S1 and a screw S2 may be coupled to each other, and thus, the first, second, and third members 410, 420, and 430 may be coupled to one another, and at the same time, the first and second option kits 510 and 520 may be accommodated in the adaptor 400.

Figure 6:
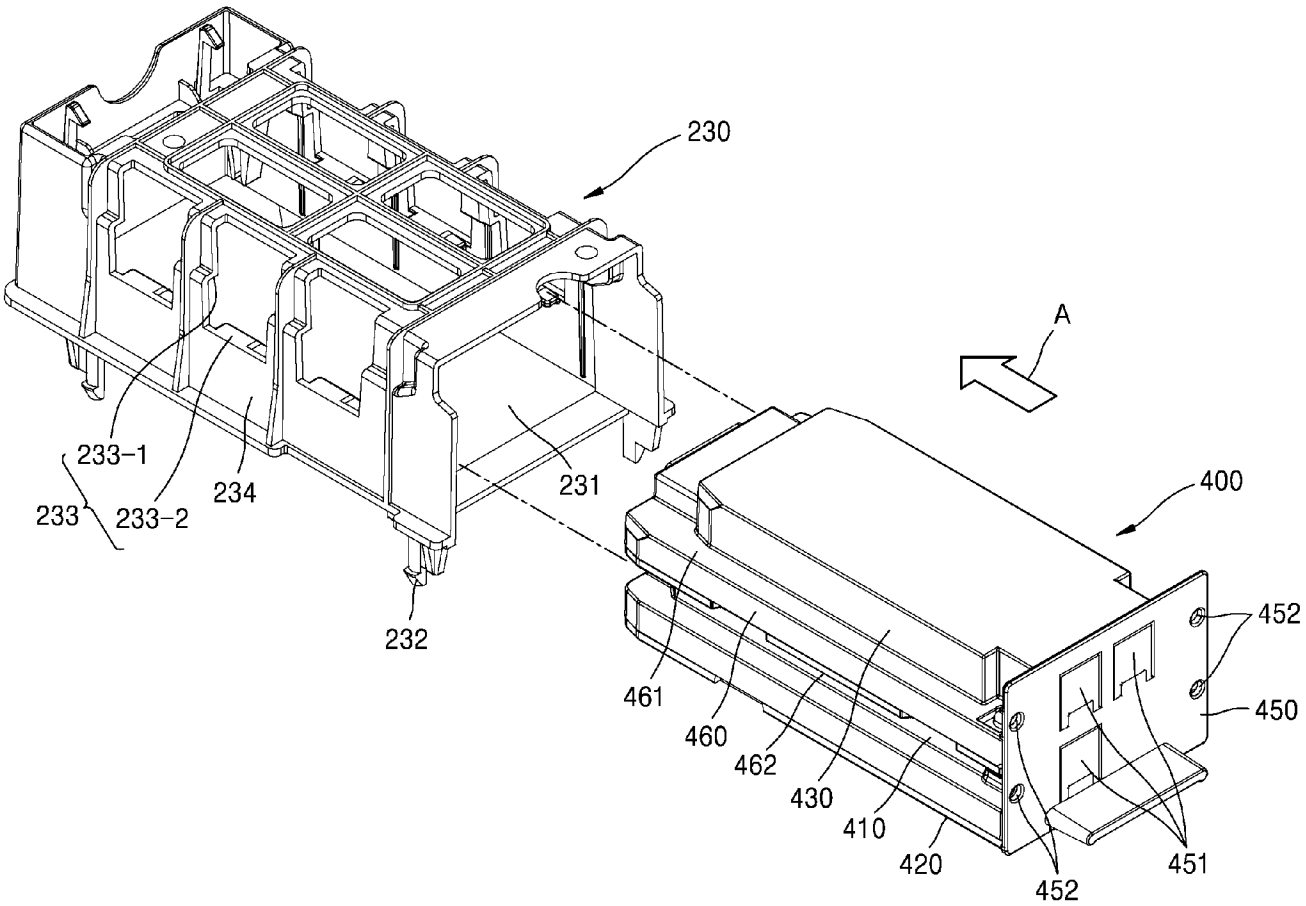
FIG. 6 is a perspective view of an exemplary mounting member on which the adaptor of is mounted.

FIG. 6 is a perspective view of the installation member 230 in which the adaptor 400 is installed. Referring to FIG. 6, the installation member 230 may include an accommodation space 231, in which the adaptor 400 is accommodated, and a fixing hook 232 fixed on the image forming apparatus 1. For example, as illustrated in FIG. 2, the image forming apparatus 1 includes a supporting bracket 240 to support the main control unit 210, and the fixing hook 232 may be fixed on the supporting bracket 240 after penetrating through the main control unit 210. The option interface unit 220 may be located in the accommodation space 231 of the installation member 230.

The installation member 230 may include a guide portion 233 that supports the adaptor 400 so that the adaptor 400 may slide in an installation direction A and is guided to the accommodation space 231 when the adaptor 400 is installed. For example, the adaptor 400 may include a guide rail 460 extending in the installation direction A, and the guide portion 233 may be formed as a recess extending in the installation direction A to support the guide rail 460. The guide portion 233 may include, for example, a first protrusion 233-1 and a second protrusion 233-2 that protrude from opposite walls 234 of the installation member 230 and are separated by a predetermined interval from each other. A surface 461 of the guide rail 460 is supported by the first protrusion 233-1 and the other surface 462 thereof may be supported by the second protrusion 233-2.

Referring to FIG. 2, the option interface unit 220 includes a connecting portion 223 that is electrically connected to connectors 511 and 521 disposed on the first and second option kits 510 and 520. The option interface unit 220 according to an embodiment connects the two or more option kits, namely, the first and second option kits 510 and 520, to the main control unit 210. As an example, the connection portion 223 includes a first connection portion 221 and a second connection portion 222. The first connection portion 221 is connected to the connector 511 of the first option kit 510, and the second connection portion 222 is connected to the connector 521 of the second option kit 520. The first and second connection portions 221 and 222 may have any kind of structures, provided that they are electrically connected to the connectors 511 and 521, respectively, and a scope is not limited by the structures of the first and second connection portions 221 and 222. For example, the first and second connection portions 221 and 222 according to an embodiment may be connected to the connectors 511 and 512 in a male-and-female coupling method. The option interface unit 220 may be disposed on a circuit board forming the main control unit 210. Also, although not illustrated in the drawings, the option interface unit 220 may be separated from the main control unit 210 and may be connected to the main control unit 210 via a signal line. The option interface unit 220 may be formed as a circuit board including the first and second connection portions 221 and 222 and may be coupled to the main control unit 210.

Processes of installing the first and second option kits 510 and 520 in the image forming apparatus 1 by using the above configuration are described.

The adaptor 400 is prepared. The adaptor 400 may be provided to a user in a preliminary assembled state. Otherwise, the adaptor 400 may be provided to the user in a disassembled state. The first and second option kits 510 and 520 may be respectively inserted between the first and second members 410 and 420 and between the first and third members 410 and 430, as illustrated in FIG. 5. The adaptor 400 may be assembled by using the screws S1 and S2. The adaptor 400 may be provided to the user in a state where the first and second option kits 510 and 520 are installed thereon.

Next, the installation hole 102 may be opened. The installation hole 102 may be opened by cutting the connecting protrusions 112, by removing the screws, or by releasing the snap fit connecting structure.

Next, the adaptor 400 may be inserted into the image forming apparatus 1 through the installation hole 102. The guide rail 460 of the adaptor 400 may be supported by the guide portion 233 of the installation member 230. When the adaptor 400 is inserted in the installation member 230, the connectors 511 and 521 of the first and second option kits 510 and 520 are respectively connected to the first and second connection portions 221 and 222 of the option interface unit 220.

Next, the adaptor 400 may be fixed in the image forming apparatus 1 by using, for example, a screw S, and then, the installation of the adaptor 400 is finished.

According to an exemplary configuration, the installation member 230, including a kind of guide portion 233 and the option interface unit 220 including two connecting portions, for example, the first and second connecting portions 221 and 222, may be provided in the image forming apparatus 1 so that the adaptor 400 including the first and second option kits 510 and 520 may be installed in the image forming apparatus 1.

The two option kits, namely, the first and second option kits 510 and 520, may be installed in the image forming apparatus 1 through different installation holes. Two installation holes to install the two option kits, namely, the first and second option kits 510 and 520, in the image forming apparatus 1, two covers respectively covering the two installation holes, and two installation members corresponding to the first and second option kits 510 and 520 may be necessary. Also, if the option kits have different external sizes, guide portions formed in the two installation members may have to be formed in different structures. Therefore, the number of components in the image forming apparatus 1 may be increased and costs for components and manufacturing costs may be increased.

If two installation members respectively corresponding to the first and second option kits 510 and 520 are provided with the first and second option kits 510 and 520 separately from the image forming apparatus 1 in order to reduce the number of components, the image forming apparatus 1 may have to be partially disassembled before installing the first and second option kits 510 and 520, and, the two installation members are installed in the image forming apparatus 1. Therefore, processes of installing the first and second option kits 510 and 520 become complicated and internal components of the image forming apparatus 1 may be damaged during disassembling and assembling processes.

According to the image forming apparatus 1 according to an embodiment, the adaptor 400 in which two option kits, namely, the first and second 510 and 520, are installed in the image forming apparatus 1. Therefore, there is no need to disassemble the image forming apparatus 1 and install the first and second option kits 510 and 520 in the image forming apparatus 1 to perform two or more additional operations may be simplified. Also, only one installation member 230 to install the adaptor 400 may be installed in the image forming apparatus 1 and the installation member 230 has only one guide portion 233, and thus, an increase in the number of components in the image forming apparatus 1 may be reduced and the image forming apparatus 1 may be capable of performing two or more additional functions while optimizing an internal space of the image forming apparatus 1 to install the option kits.

Figure 7:
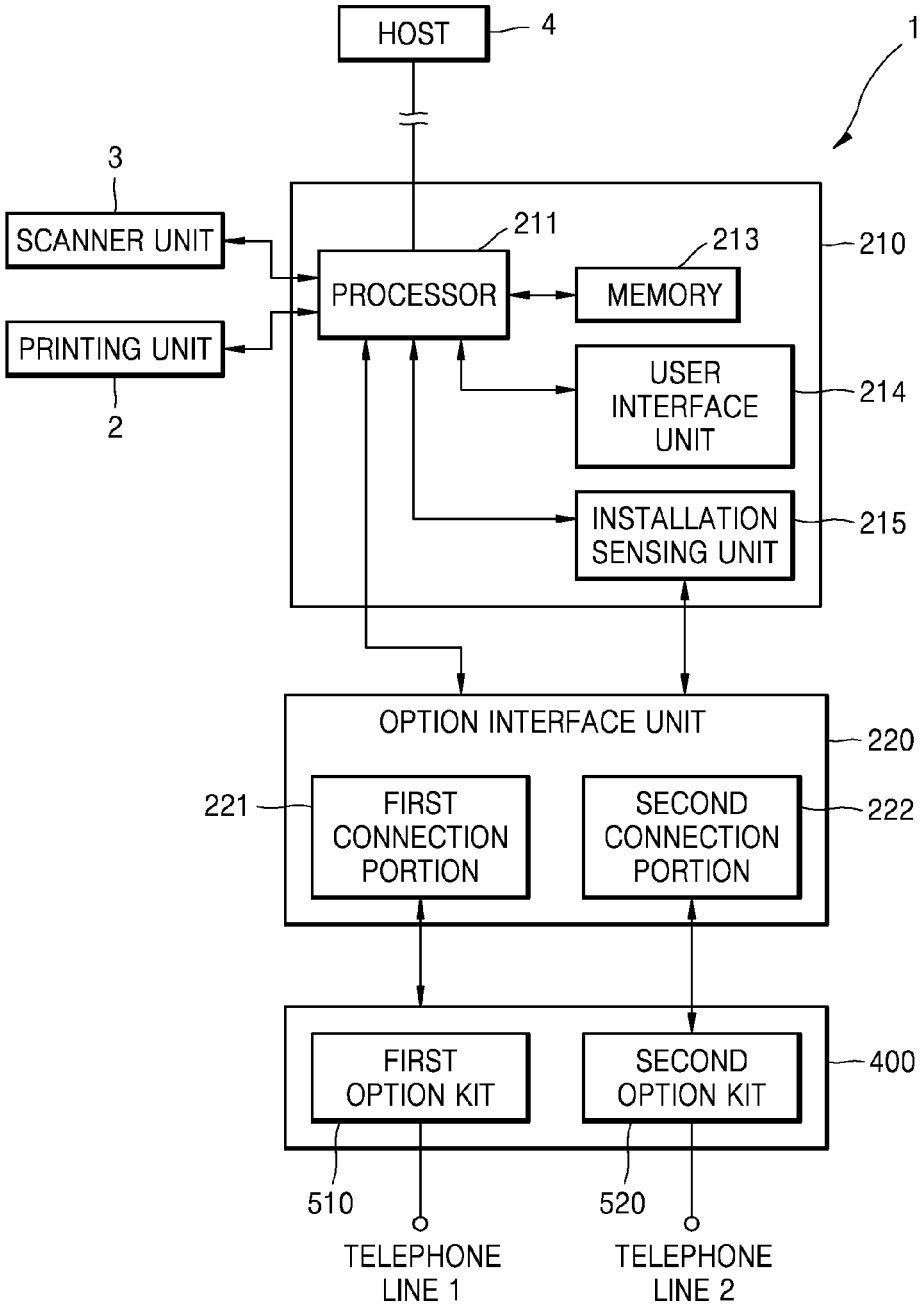
FIG. 7 is a block diagram of an exemplary image forming apparatus on which two option kits are installed.

FIG. 7 is a systemic block diagram of the image forming apparatus 1 in which two option kits, namely, the first and second option kits 510 and 520, are installed. Referring to FIG. 7, the first option kit 510 is a single fax card and the second option kit 520 is a dual fax card. The image forming apparatus 1 may operate as a fax using two telephone lines (telephone line 1 and telephone line 2). The main control unit 210 may include a processor 211, a memory 213, and a user interface unit 214. The processor 211 may be formed by an electric circuit including a CPU and controls overall operations of the image forming apparatus 1. The processor 211 may be driven by, for example, software stored in the memory 213, or may be driven by software provided from a host 4. The user interface unit 214 may be connected to, for example, an input device (not illustrated) to input a manipulation command of the user and an output device (not illustrated) to display operational states of the image forming apparatus 1. The user interface unit 214 receives the manipulation command of the user via the input device and transmits an output signal to the output device so as to display the operational state of the image forming apparatus 1.

When the adaptor 400 in which the first and second option kits 510 and 520 is installed in the image forming apparatus 1 is loaded, the first and second option kits 510 and 520 may be respectively connected to the first and second connection portions 221 and 222 of the option interface unit 220 so as to exchange signals with the main control unit 210. For example, the main control unit 210 receives installation signals of the first and second option kits 510 and 520 via an installation sensing unit 215. When receiving the installation signals, the main control unit 210 recognizes that the two telephone lines are available.

The main control unit 210 receives image information provided from the host 4 and controls a printing unit 2 so as to print an image on the recording medium P. The main control unit 210 reads image information that is read from the document by using the scanner unit 3 and controls the printing unit 2 to print the read image information on the recording medium P. The main control unit 210 may control the first option kit 510 and/or the second option kit 520 to transmit the read image information via the telephone line 1 and/or the telephone line 2. In addition, the main control unit 210 may control the first option kit 510 and/or the second option kit 520 to receive the image information via the local 1 and/or the local 2 and may control the printing unit 2 to print the image information on the recording medium P.

According to an embodiment, the first and second option kits 510 and 520 are the single fax card and the dual fax card; however, the embodiments are not limited thereto. For example, the first and second option kits 510 and 520 may be combinations of the single fax card, a Wi-Fi card, and a network card.

When the Wi-Fi card is installed, the image forming apparatus 1 may be connected to a router connected to an infrastructure network, that is, an access point (AP). The Wi-Fi card may have a Wi-Fi direct (WFD) function. The image forming apparatus 1 may function as a multi-functional apparatus supporting WFD. According to the WFD function, one of the WFD devices that are to form a wireless network performs as an AP, and the other WFD devices perform as stations that are wirelessly connected to the WFD device performing as the AP. Therefore, the WFD devices may form the wireless network without an AP connected to the infrastructure network. When the wireless network is formed between the WFD devices, wireless LAN devices such as Wi-Fi devices may recognize the WFD device performing as the AP as an AP and may be wirelessly connected to the WFD device.

When the network card is installed, the image forming apparatus 1 may be connected to the infrastructure network through wires. Therefore, the image forming apparatus 1 may perform as a network printer or a network scanner.

According to an embodiment, the adaptor 400 includes two option kits, namely, the first and second option kits 510 and 520; however, the embodiments are not limited thereto. Although not illustrated in the drawings, the adaptor 400 may have a structure in which three or more option kits may be accommodated. The option interface unit 220 may include three or more connection portions.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. An image forming apparatus comprising:

a printing unit to print images on a recording medium;

an installation member having an accommodation space;

an adaptor, on which two or more option kits are loaded, detachably attached to the accommodation space of the installation member, a main control unit to control operations of the image forming apparatus; and an option interface unit to connect the two or more option kits to the main control unit when the adaptor is installed in the installation member, wherein at least some of the two or more option kits loaded in the adaptor are separated from each other by a first member located between the respective two or more option kits, and wherein the option interface unit comprises two or more connecting portions that are respectively connected to the two or more option kits.

2. The image forming apparatus of claim 1, wherein the adaptor comprises a guide rail, and the installation member comprises a guide unit to support the guide rail so as to guide the adaptor to the accommodation space.

3. The image forming apparatus of claim 1, further comprising a housing having an installation hole, wherein a cover that is removable is disposed on the installation hole.

4. The image forming apparatus of claim 3, wherein the adaptor further comprises a fixing bracket that blocks the installation hole.

5. The image forming apparatus of claim 4, wherein the fixing bracket comprises a connecting hole to connect the two or more option kits to the outside.

6. The image forming apparatus of claim 4, wherein the fixing bracket includes a fixing hole to fix the adaptor.

7. The image forming apparatus of claim 1, wherein the two or more option kits include at least two of a fax card, a wireless fidelity (Wi-Fi) card, and a network card.

8. An option kit adaptor that may be detachably attached to an image forming apparatus through an installation hole formed in the image forming apparatus, the option kit adaptor comprising:

a first member;

a second member facing one side of the first member and forming a first accommodation space, in which a first option kit is installed, with the first member;

a third member facing a second side of the first member opposing the first side and forming a second accommodation space, in which a second option kit is installed, with the first member; and a fixing bracket to block the installation hole, wherein the first option kit is separated from the second option kit by the first member.

9. The option kit adaptor of claim 8, wherein the fixing bracket comprises fixing holes to fix the option kit adaptor to the image forming apparatus.

10. The option kit adaptor of claim 8, further comprising a ground bracket for grounding the first option kit and the second option kit.

11. The option kit adaptor of claim 8, further comprising a guide rail that is guided by a guide unit of an installation member in the image forming apparatus.

12. An option kit adaptor that may be detachably attached to an apparatus through an installation hole formed in the apparatus, the option kit adaptor comprising:

a first member;

a second member forming a first accommodation space, in which a first option kit is installed, with the first member; and a third member forming a second accommodation space, in which a second option kit is installed, with the first member, wherein at least one of the first option kit and the second option kit being one of a single fax card, a Wi-Fi card and a network card.

* * * * *